US009430883B2

(12) United States Patent
Busse et al.

(10) Patent No.: US 9,430,883 B2
(45) Date of Patent: Aug. 30, 2016

(54) DEVICE WITH VEHICLE INTERFACE FOR SENSOR DATA STORAGE AND TRANSFER

(71) Applicant: Verizon Patent and Licensing Inc., Arlington, VA (US)

(72) Inventors: Martin A Busse, Woburn, MA (US); Siddharth Chitnis, Irving, TX (US)

(73) Assignee: VERIZON PATENT AND LICENSING INC., Basking Ridge, NJ (US)

( * ) Notice: Subject to any disclaimer, the term of this patent is extended or adjusted under 35 U.S.C. 154(b) by 0 days.

(21) Appl. No.: 14/458,496

(22) Filed: Aug. 13, 2014

(65) Prior Publication Data

US 2016/0049017 A1 Feb. 18, 2016

(51) Int. Cl.
*G07C 5/00* (2006.01)
*G07C 5/08* (2006.01)

(52) U.S. Cl.
CPC ..... *G07C 5/008* (2013.01); *G07C 5/0858* (2013.01); *G07C 5/0866* (2013.01)

(58) Field of Classification Search
USPC ..... 701/2, 36–49; 348/14.01–14.16, 348/143–160; 180/271–290
See application file for complete search history.

(56) References Cited

U.S. PATENT DOCUMENTS 7,457,693 B2 * 11/2008 Olsen ..... B60R 25/1004 180/287
2012/0105637 A1 * 5/2012 Yousefi ..... H04N 7/183 348/148
2012/0143918 A1 * 6/2012 Hao ..... H04L 41/5064 707/791
2013/0127980 A1 * 5/2013 Haddick ..... G06F 3/013 348/14.08
2014/0142783 A1 * 5/2014 Grimm ..... H04W 4/008 701/2
2015/0193885 A1 * 7/2015 Akiva ..... G06Q 40/08 705/4
2015/0232065 A1 * 8/2015 Ricci ..... B60R 25/01 701/36

* cited by examiner

*Primary Examiner* — Adam Tissot
*Assistant Examiner* — Timothy Nesley

(57) ABSTRACT

A device may store and transmit data collected from sensors within a vehicle. The device may include at least one communication interface; a memory configured to store instructions; and a processor, coupled to the at least one communication interface and the memory. The processor may be configured to execute the instructions stored in the memory. The instructions may cause the processor to receive an initiation signal from an on-board interface associated with a vehicle, establish communications with the on-board interface and at least one vehicle sensor in response to the initiation signal, receive a first data stream from the at least one vehicle sensor, generate a second data stream from the least one internal sensor, combine the first data stream and the second data stream into a combined stream, store the combined stream in the memory, and wirelessly transmit the combined stream to a remote storage and retrieval system.

20 Claims, 7 Drawing Sheets

DEVICE WITH VEHICLE INTERFACE FOR SENSOR DATA STORAGE AND TRANSFER

BACKGROUND

Cameras mounted within automobiles have been commonly used by law enforcement to record scenes from the viewpoint of the driver for evidentiary purposes. Such cameras may commonly be referred to as "dash cameras" or "dash cams." As technology advances, the quality and reliably of dash cameras improves while their cost are being reduced. Accordingly, the popularity of dash cameras use among non-law enforcement personal has increased.

DETAILED DESCRIPTION OF THE PREFERRED EMBODIMENTS

The following detailed description refers to the accompanying drawings. The same reference numbers in different drawings may identify the same or similar elements. The following detailed description does not limit the invention.

Embodiments described herein are directed to a mobile device that collects sensor data within a vehicle and wirelessly transfers the collected data to one or more remote systems. The mobile device may be placed within a vehicle, and may automatically interface with the vehicle's electronics system, as will be described in more detail below. As used herein, the term "collecting" may refer to sensor data which is generated by internal sensors that can be found in mobile devices, sensor data which may be received from sensors associated with the vehicle (referred to herein as "vehicle sensors"), or combinations thereof. The data may be collected over periods of time, and thus may be referred to herein as a "data stream." In an embodiment, the mobile device may generate one or more data streams using its own internal sensors while receiving data from one or more vehicle sensors. The collected data (both the generated data and received data) may be consolidated and stored on the mobile device, and may simultaneously be transferred (e.g., streamed) over a wireless connection to a remote system (e.g., stored in "the cloud").

Figure 1A:
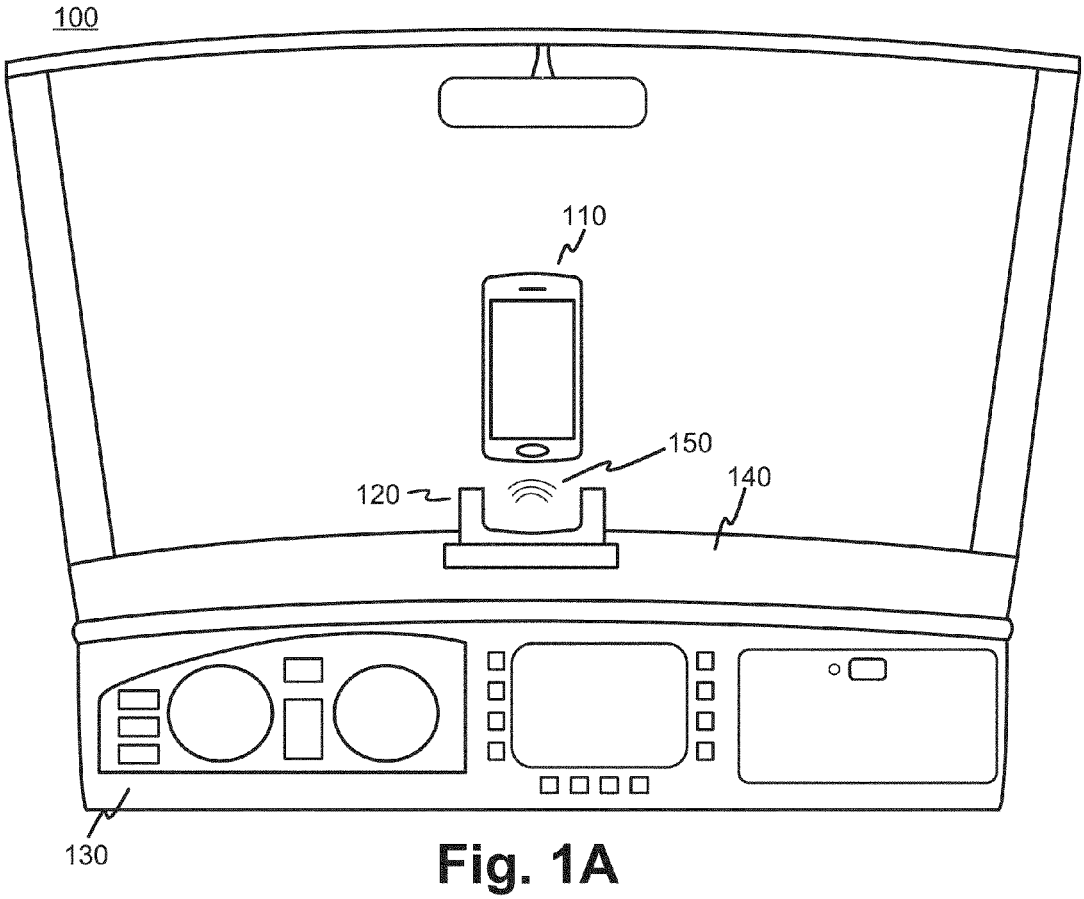
FIGS. 1A and 1B provide different views of an interior of an exemplary vehicle where sensor data may be collected and/or wirelessly transferred.

FIG. 1A is an illustration of an exemplary vehicle interior 100 where sensor data may be collected and/or wirelessly transferred. The perspective shown in FIG. 1A is from the viewpoint of a front-seat occupant looking towards the front of the vehicle, showing a dashboard 130 underneath a dash pad 140. A fixed structure may be mounted to dash pad 140 which may include, for example, a cradle 120 that can interface to one or more vehicle electronic systems (VESs) within the vehicle. A mobile device 110 may be physically secured to cradle 120, and mobile device 110 may establish electrical connections with one or more VESs through cradle 120. Cradle 120 may provide the interface using physical connections to one or more VESs, such as, for example, using industry standard interfaces and protocols. Additionally, or alternatively, wireless channels between mobile device 110 and the vehicle may be used for interfacing with one or more VESs so mobile device may, for example, receive data streams from one or more vehicle sensors. The wireless channels may be supported by wireless technology standards which may include, for example, Bluetooth, Bluetooth Low Energy, Zigbee, WiFi, etc.

Additional wireless interfaces may be used, for example, to facilitate the interface of mobile device 110 with the vehicle. For example, cradle 120 may use a Near Field Communication (NFC) wireless channel 150 to exchange information with mobile device 110. NFC wireless channel 150 may be used to exchange credentials for verification, trigger processes on mobile device 110, such as, for example, start an application automatically for collecting data streams, and/or prompt the user for operational preferences. Cradle 120 may further provide electrical power to mobile device 110 so it may be charged (either inductively or through a physical connection) while mounted within cradle 120.

Mobile device 110 may include any type of electronic device having communication capabilities, and thus communicate over a network using one or more different channels, including both wired and wireless connections. Mobile device 110 may include, for example, a cellular mobile phone, a smart phone, a tablet, any type of Internet Protocol (IP) communications device, a laptop computer, a palmtop computer, a media player device, or a digital camera that includes communication capabilities (e.g., wireless communication mechanisms).

Figure 1B:
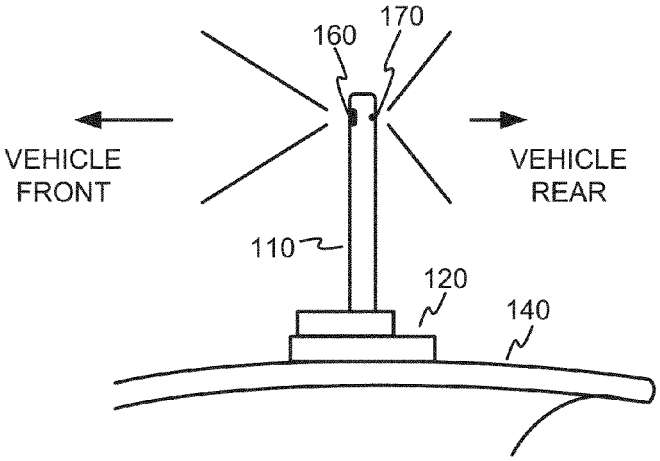

FIG. 1B is an illustration showing a different perspective of mobile device 110 viewed from the left side within the vehicle interior 100. One or more on board sensors within mobile device 110 may be used to generate data streams for storage and subsequent transmission to a remote system. For example, one sensor may be a front facing camera 160 that can generate camera data looking toward the front of the vehicle through the windshield, and a rear facing camera 170 may generate camera data of the vehicle's interior. As used herein, camera data may include image data, video data, or a combination thereof. In addition to generating data using front facing camera 160 and/or rear facing camera 170, mobile device 110 may also receive data streams from vehicle sensor(s), which may be combined and stored within mobile device 110 and/or wirelessly transferred to a remote system.

In an embodiment, the user may use the input of mobile device 110 to alter preferences in an application to turn off the camera facing the interior of the vehicle, or change other functionality such as selectively storing and/or transferring sensor data.

In another embodiment, cradle 120 may instead support a dedicated sensor, such as, for example, a stand-alone camera for viewing out of the front of the vehicle and/or rearward into the vehicle interior. The stand-alone camera may be removably or fixedly attached to cradle 120, and provide data streams to mobile device 110, either wirelessly or through a wireless channel. Such an arrangement may permit mobile device 110 to be placed in different locations which may be less conspicuous to avoid theft and/or better shielded from sunlight to permit cooler operation of mobile device 110.

Vehicle interior 100 is shown as an automobile interior, however, embodiments provided herein may be used in association with any type of vehicle. For example, vehicle 100 could be any type of land vehicle (e.g., a truck, van, sport utility, motorcycle, etc.), motorized watercraft (e.g., recreational boats), or small aircraft.

Figure 2:
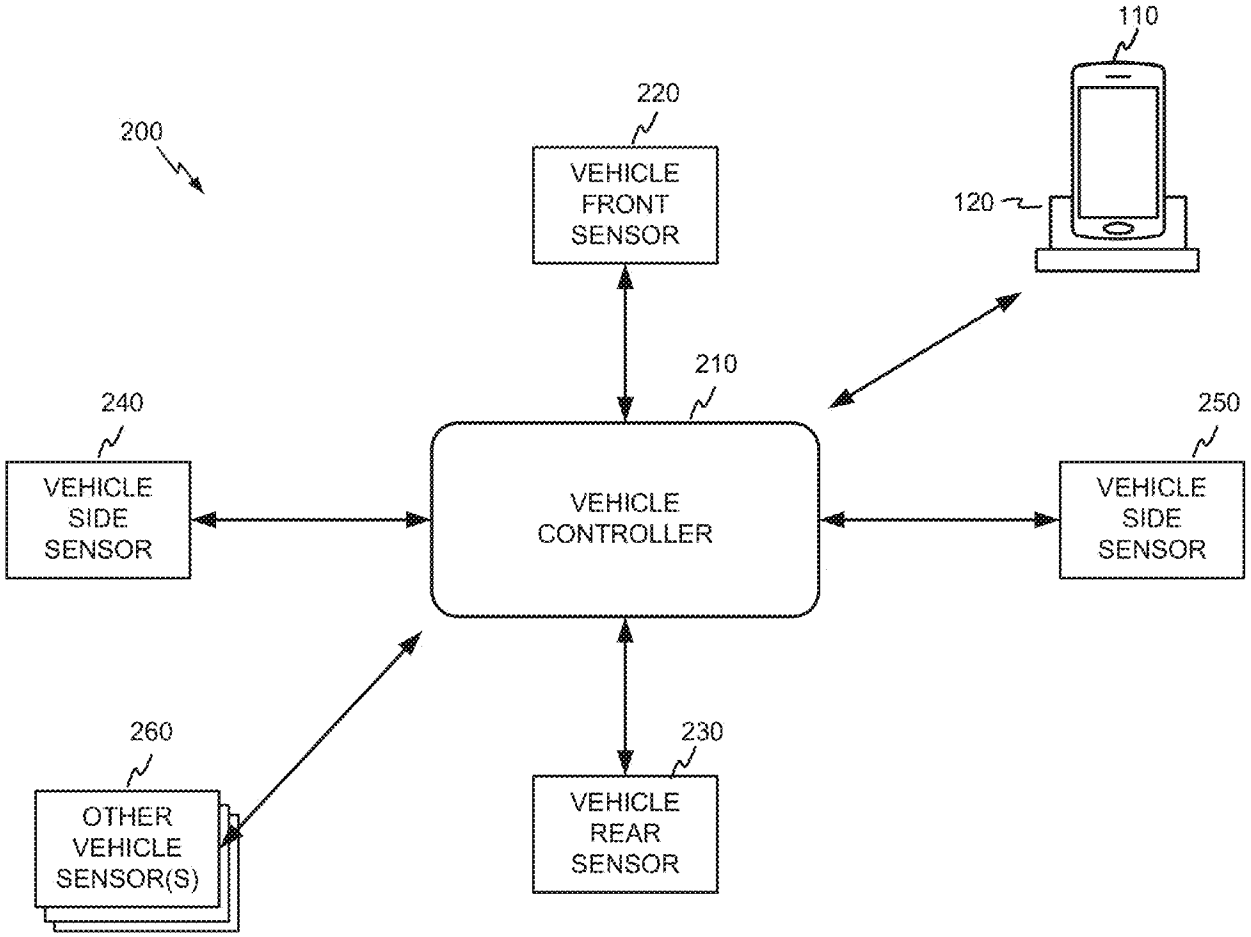
FIG. 2 is a block diagram showing an exemplary vehicle sensor system.

FIG. 2 is a block diagram showing an exemplary vehicle sensor system 200 in relation to mobile device 110 and cradle 120. Vehicle sensor system 200 may include a vehicle controller 210 and a plurality of sensors, which may be distributed in or on the vehicle in accordance with their collection functionality, and may include vehicle front sensor 220, vehicle side sensors 240, 250, and vehicle rear sensor 230. One or more other vehicle sensors 260 may also be placed within the vehicle, where their location on or within the vehicle may vary and may or may not be based on their collection functionality.

Vehicle sensors 220-260 may interface with vehicle controller 210 over wired and/or wireless interfaces, where vehicle controller 210 may receive the generated data streams and/or send commands to one or more vehicle sensors 220-260. Vehicle controller 210 may forward one or more of the data streams to specialized processors and/or driver displays.

For example, one or more of vehicle front sensor 220, vehicle side sensors 240, 250, and vehicle rear sensor 230 may be image sensors (e.g., cameras) which can collect image and/or video data streams, non-imaging proximity sensors which determine distance to objects, and/or any other type of sensor. Cradle 120 may interface with vehicle controller 210 using a wired and/or wireless connection. The wired interface may include an industry standard interface such as, for example, an On-Board Diagnostics (OBD) interface (e.g., Society of Automotive Engineers standards including OBD-I, OBD-II, etc.) Additionally or alternative, a local area network within the vehicle may be used to interface with cradle 120 and/or directly with mobile device 110. Such local area networks may be supported by WiFi, Bluetooth (e.g., Bluetooth LE), Zigbee, etc. Mobile device 110 may receive sensor data in a synchronous and/or asynchronous manner over periods of time while the vehicle is operating, or during periods of time when the vehicle is stationary, which may be designated depending upon the preferences of the operator. While FIG. 2 shows mobile device 110 collecting data from vehicle sensors 220-260 through vehicle controller 210, in other embodiments, mobile device 110 may receive the sensor data directly from one or more sensors.

Vehicle sensors 220-260, as described above, may include image sensors (e.g., cameras) which generate image and/or video data streams. For example, the image sensors may use visible light and/or non-visible radiation in the infrared wavelengths, which may be used at night. Vehicle sensors 220-260 may be active sensors which generate energy and receive signals in the form of reflected energy to derive useful information. For example, vehicle front sensor 220 may be a radar and/or an infrared based sensor which may be used in collision avoidance and/or adaptive cruise control. Vehicle rear sensor 230 and side sensors 240, 250 may include ultrasonic and/or radio sensors for proximity detection. Other vehicle sensors 260 may include accelerometers, barometric sensors for altitude, Global Positioning System (GPS) receives for position determination, distance sensors which may be used for dead reckoning, magnetic compasses, attitude sensors such as gyroscopes (e.g., mechanical or laser ring), Micro-Electro-Mechanical Systems (MEMS) sensors, etc.

Vehicle controller 210 may be part of a telematics system, which can collect, process, and transfer data streams received from vehicle sensors 220-260. Vehicle controller 210 may further interface with mobile device 110, for example, through a standard wired and/or wireless interface, to provide information which may include data streams from vehicle sensors 220-260. Mobile device 110 may provide various status and/or other information (e.g., such as communication parameters, user credentials, etc.) to vehicle controller 210. Vehicle controller 210 may include any type of single-core processor, multi-core processor, microprocessor, latch-based processor, and/or processing logic (or families of processors, microprocessors, and/or processing logics) that interprets and executes instructions. In other embodiments, vehicle controller 210 may include an application-specific integrated circuit (ASIC), a field-programmable gate array (FPGA), and/or another type of integrated circuit or processing logic. For example, vehicle controller may be an x86 based CPU, and may use any suitable operating system, real-time operating system, etc.

Figure 3:
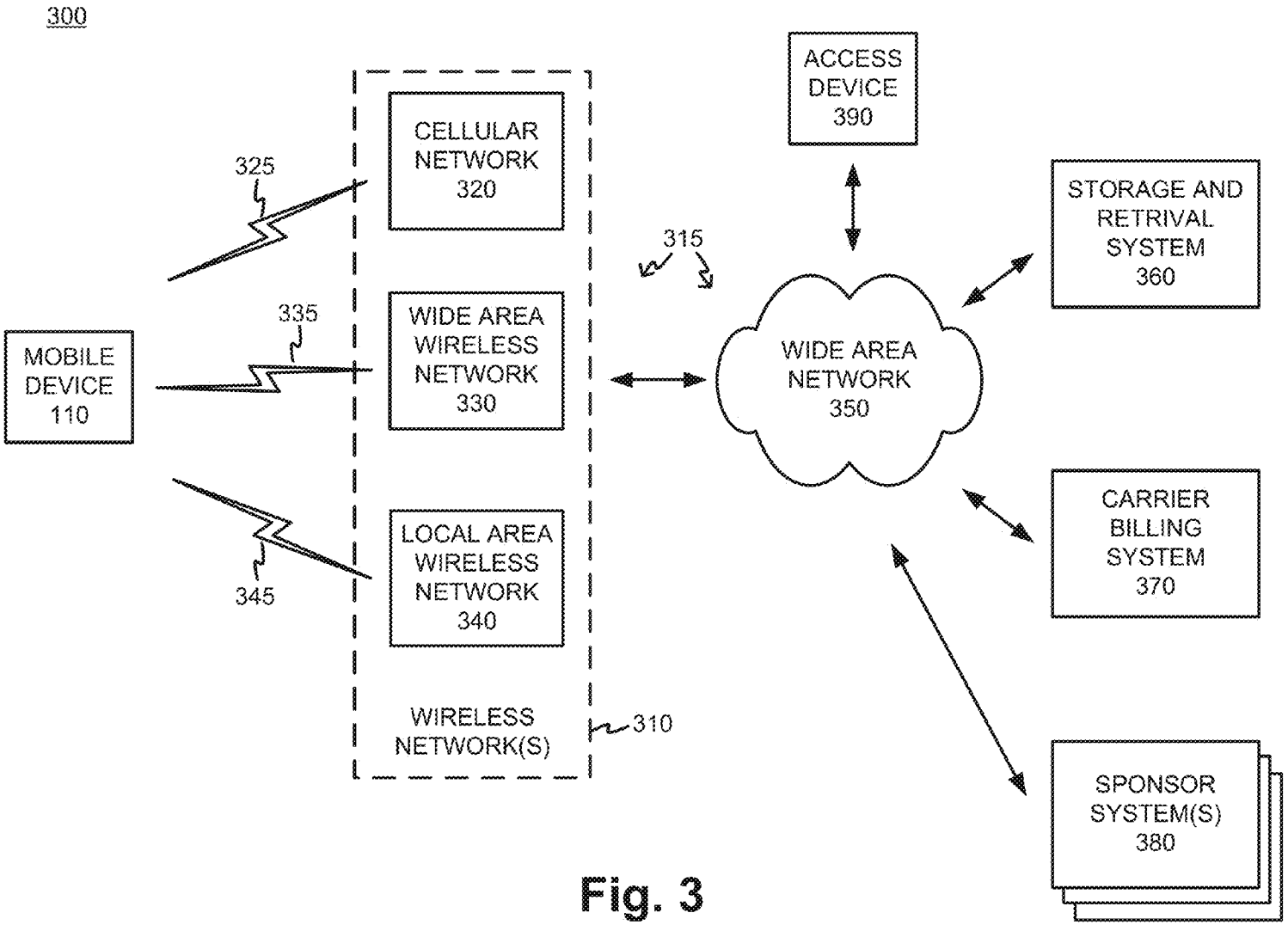
FIG. 3 is a block diagram showing an exemplary network used to transfer data streams according to an embodiment.

FIG. 3 is a block diagram illustrating an exemplary network environment 300 which may be used for transferring data streams produced by vehicle sensor system 200 to various back end systems. Network environment 300 may include one or more mobile devices 110, network 315, storage and retrieval system 360, carrier billing system 370, sponsor system(s) 380, and one or more access devices 390. Network 315 may include one or more wireless network(s) 310 and a wide area network 350. Wireless networks 310 may further include, for example, a cellular network 320 (such as, for example, an LTE network shown in FIG. 4), a wide area wireless network 330, and/or a local area wireless network 340. For ease of explanation, only one mobile device 110 systems 360-380 are illustrated as being connected to network 315. However, it should be understood that a large number of mobile devices 110, systems 360-380, and/or other network entities may be communicatively coupled to network 315.

Mobile device 115 may obtain access to network 315 through wireless network(s) 310 over any type of known radio channel or combinations thereof. For example, mobile device 110 may access cellular network 320 over wireless channel 325. Access over wireless channel 325 may be provided through a base station, eNodeB, etc., within cellular network 320, as will be described in more detail below in reference to an embodiment shown in FIG. 4. In various embodiments, cellular network 320, wide area wireless network 330, and/or local area wireless network 340 may also communicate with each other in addition to mobile device 110. Mobile device 110 may also access network 315 over wireless channel 335 through wide area wireless network 330. Wide area wireless network 330 may include any type wireless network covering larger areas, and may include a mesh network (e.g., IEEE 801.11s) and/or or a WiMAX IEEE 802.16. Mobile device 110 may access network 315 over wireless channel 345 through local area wireless network 340, which may include WiFi (e.g., any IEEE 801.11x network, where x=a, b, c, g, and/or n) and/or any type of Bluetooth network. The wireless network(s) 310 may exchange data with wide area network 350 which could include backhaul networks, backbone networks, and/or core networks. Storage and retrieval system 360, carrier billing system 370, and sponsor systems 380 may interface with wide area network 350, and thus with mobile device 110 over one or more of the air interfaces 325, 335, 345 through wireless network(s) 310.

Mobile device 110 may generate data streams from one or more of its internal sensors (e.g., front facing camera 160, rear facing camera 170) and/or collect additional data streams from vehicle sensors 220-260, combine the data streams and transfer them to storage and retrieval system 360 over network 315. The data streams may be transferred over one or more wireless channels by initially being buffered in "batches" and transmitted in bursts to maximize wireless channel efficiencies as the conditions of the wireless channel change as the vehicle moves. Alternatively, the data streams may be "streamed" in real time to storage and retrieval system 360 shortly after the streams are collected and consolidated by mobile device 110. Once stored by storage and retrieval system 360, the stored data streams may be access and played back over any wireless channel (e.g., 325, 335, or 345) by mobile device 110 or any other wireless device (e.g., a laptop), or may be accessed by an access device 390 which may have wired access to network 315. Charges for network access to the stored data streams may be determined by carrier billing system 370, which may be further subsidized or otherwise altered as determined by one or more sponsor system(s) 380 as will be described below.

For example, there may be a number of business relationships in which sponsors could subsidize wireless access charges, software, and/or hardware costs associated with collecting and transferring data streams for storage over network 310 and/or 350. In one embodiment, a user associated with mobile device 110 may not be charged wireless access fees for transferring and/or storing data streams over, for example, cellular network 320, but may incur wireless charges if the cellular network 320 is used in retrieving the stored data streams for viewing. Such fees may be avoided if other networks (e.g., local area wireless networks 340) are used in accessing the stored data streams. Alternatively, free access to the stored data streams may also be provided if access is performed over access device 390 through, for example, a wired network connection.

Various partnerships may also be established with the automotive and insurance industries which may benefit from the data streams, which may be used for evidentiary purposes for accidents and proof of liability or for other genera data collection purposes (e.g., analysis of driving habits). The data streams may also be used to supplement other roadside emergency and assistance services which are currently provided by many auto manufacturers (such as, for example, On-Star). Sensors in mobile device 110 (e.g., cameras, accelerometers, GPS, etc.) may be used as a supplement to on-vehicle sensor data to improve accident detection, location and reduce response time. For example, data streams from cameras mobile device 110 may provide different views than other cameras within the vehicle.

Vehicle owners may also enter programs sponsored by insurance companies to allow the insurance companies use of the data streams for driver safety programs, liability determination, etc., in exchange for sponsoring aspects of the system (e.g., free or discounted mobile device 110, software support (free apps), and/or sponsored wireless access) and/or providing reduced insurance rates. For example, embodiments may be used to monitor teen driving, where the both the outside and inside of the vehicle may be monitored, in addition to the dynamics of the vehicle (including its speed and location history). Thus, parents may able to determine the behavior of their teen in various driving situations when they cannot be present.

Wireless network(s) 310 may include one or more wireless networks of any type, such as, for example, a local area network (LAN), a wide area network (WAN), a wireless satellite network, and/or one or more wireless public land mobile networks (PLMNs). The PLMN(s) may include a Code Division Multiple Access (CDMA) 2000 PLMN, a Global System for Mobile Communications (GSM) PLMN, a Long Term Evolution (LTE) PLMN and/or other types of PLMNs not specifically described herein.

Wide area network 350 may be any type of wide area network connecting backhaul networks and/or core networks, and may include a metropolitan area network (MAN), an intranet, the Internet, a cable-based network (e.g., an optical cable network), networks operating known protocols, including Asynchronous Transfer Mode (ATM), Optical Transport Network (OTN), Synchronous Optical Networking (SONET), Synchronous Digital Hierarchy (SDH), Multiprotocol Label Switching (MPLS), and/or Transmission Control Protocol/Internet Protocol (TCP/IP).

Storage and retrieval system 360 may include a computer, a server, or other computing device which receives the data streams from a plurality of mobile devices 110 associated with wireless customer accounts for storage and playback of the data streams. Carrier billing system 370 may include a computer, a server, or other computing device which tracks various charges associated with usage of any portion of network 315 (e.g., access to cellular network 320 and/or wide area network 350). Carrier billing system 370 may utilize rules in which use of wireless networks (e.g., cellular network 320) for transferring data streams from internal sensors of mobile device 110 and/or vehicle sensors may be exempt from airtime charges, or may be subsidized by a sponsor having a business relationship with the network carrier. Sponsor system(s) 380, which may include server hardware and software, may enforce rules which automatically determine reduce rates for different data stream transfers, and may provide such information to carrier billing system 370 modify airtime charges accordingly.

Figure 4:
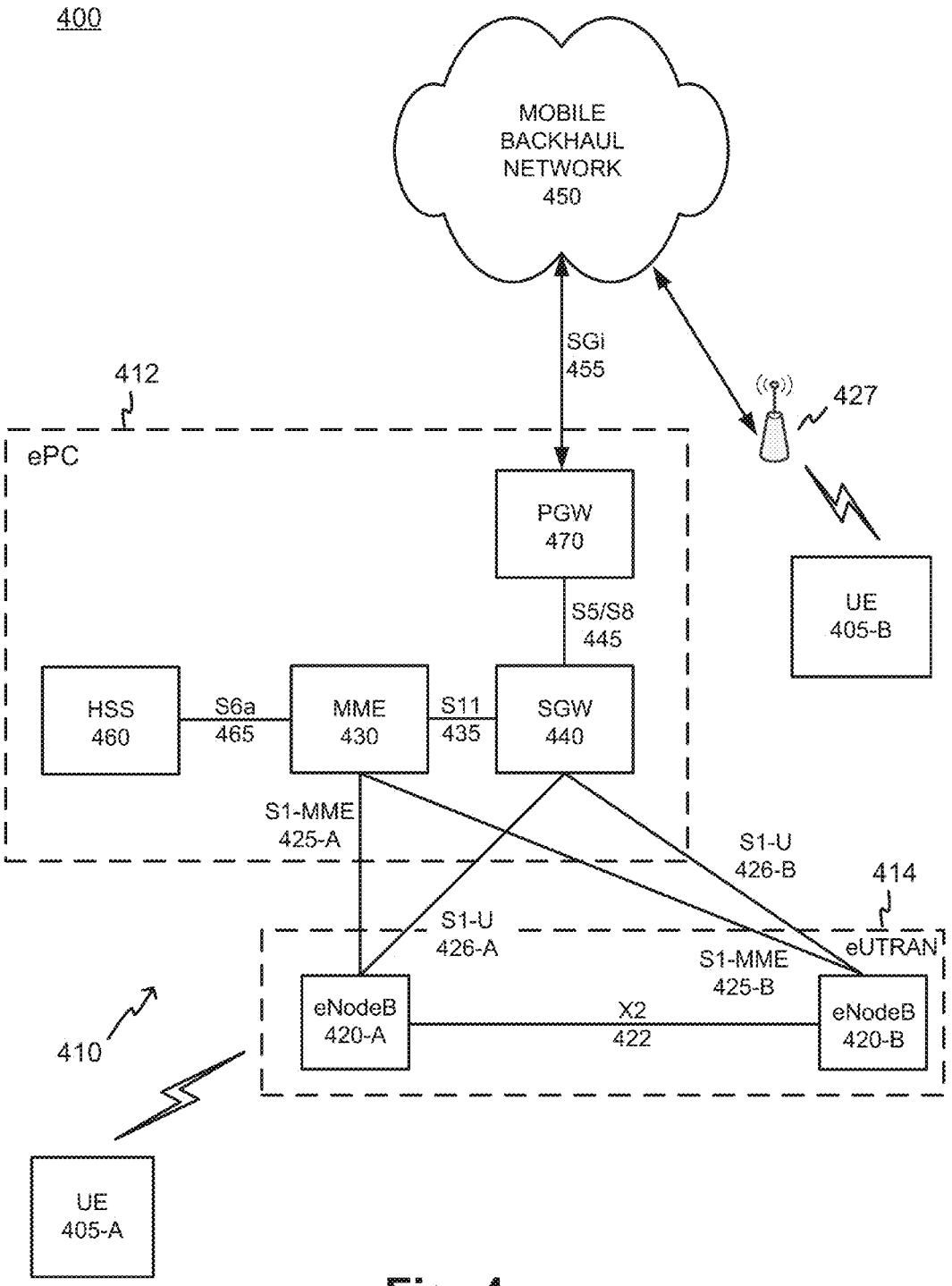
FIG. 4 is a block diagram illustrating an exemplary Long Term Evolution (LTE) network.

FIG. 4 is a block diagram illustrating an exemplary Long Term Evolution (LTE) network 400 which may be included in cellular network 320 show in FIG. 3. LTE network 400 may include mobile devices 110 embodied as UEs 405-A and 406-B (as used herein, collectively referred to as "UE 405" and individually as "UE 405-*x*"), a wireless network 410 which includes an evolved Packet Core (ePC) 412 and an evolved UMTS Terrestrial Network (eUTRAN) 414, a backhaul network 450, and a WiFi wireless access point (WAP) 427.

Wireless network 410 may include one or more devices that are physical and/or logical entities interconnected via standardized interfaces. Wireless network 410 provides wireless packet-switched services and wireless IP connectivity to user devices to provide, for example, which include data, voice, and/or multimedia services. The ePC 412 may further include a mobility management entity (MME) 430, a serving gateway (SGW) device 440, a packet data network gateway (PGW) 470, and a home subscriber server (HSS) 460. The eUTRAN 414 may further include one or more eNodeBs (herein referred to collectively as "eNodeB 420" and individually as "eNodeB 420-*x*"). It is noted that FIG. 4 depicts a representative LTE network 400 with exemplary components and configuration shown for purposes of explanation. Other embodiments may include additional or different network entities in alternative configurations than which are exemplified in FIG. 4.

Further referring to FIG. 4, each eNodeB 420 may include one or more devices and other components having functionality that allow UE 405 to wirelessly connect to eUTRAN 414. eNodeB 420 may interface with ePC via a S1 interface, which may be split into a control plane S1-MME interface 425 and a data plane S1-U interface 426. S1-MME interface 425 may interface with MME device 430. S1-MME interface 425 may be implemented, for example, with a protocol stack that includes a Network Access Server (NAS) protocol and/or Stream Control Transmission Protocol (SCTP). S1-U interface 426 may provide an interface with SGW 440 and may be implemented, for example, using a General Packet Radio Service Tunneling Protocol version 2 (GTPv2). eNodeB 420-A may communicate with eNodeB 420-B via an X2 interface 422. X2 interface 222 may be implemented, for example, with a protocol stack that includes an X2 application protocol and SCTP.

MME device 430 may implement control plane processing. For example, MME device 430 may implement tracking and paging procedures for UE 405, may activate and deactivate bearers for UE 405, may authenticate a user of UE 405, and may interface to non-LTE radio access networks. A bearer may represent a logical channel with particular quality of service (QoS) requirements. MME device 430 may also select a particular SGW 440 for a particular UE 405. A particular MME device 430 may interface with other MME devices 430 in ePC 412 and may send and receive information associated with UEs, which may allow one MME device to take over control plane processing of UEs serviced by another MME device, if the other MME device becomes unavailable. MME device 430 may communicate with SGW 440 through an S11 interface 435. S11 interface 435 may be implemented, for example, using GTPv2. S11 interface 435 may be used to create and manage a new session for a particular UE 405. S11 interface 435 may be activated when MME device 430 needs to communicate with SGW 440, such as when the particular UE 405 attaches to ePC 412, when bearers need to be added or modified for an existing session for the particular UE 405, when a connection to a new PGW 470 needs to created, or during a handover procedure (e.g., when the particular UE 405 needs to switch to a different SGW 440).

SGW 440 may provide an access point to and from UEs 405, may handle forwarding of data packets for UE 405, and may act as a local anchor point during handover procedures between eNodeBs 420. SGW 440 may interface with PGW 470 through an S5/S8 interface 445. S5/S8 interface 445 may be implemented, for example, using GTPv2.

PGW 470 may function as a gateway to IP network 450 through a SGi interface 455. Backhaul network 450 may interconnect to an IP Multimedia Subsystem (IMS) network, which may provide voice and multimedia services to UE 405, based on Session Initiation Protocol (SIP). A particular UE 405-A, while connected to a single SGW 440, may be connected to multiple PGWs 470, one for each packet network with which UE 405-A communicates.

Alternatively, UE 405-B may exchange data with IP network 450 though WiFi wireless access point WAP 427. The WiFi WAP 427 may be part of a local area network, and access backhaul network 450 through a wired connection via a router. Alternatively, WiFi WAP 427 may be part of a mesh network (e.g., 801.11s). WiFi WAP 427 may be part of a local area network, or part of a wide area network (WiMaxx) or a mesh network (801.11s).

HSS 460 may store information associated with UEs 405 and/or information associated with users of UEs 405. For example, HSS 460 may store user profiles that include authentication and access authorization information. MME device 430 may communicate with HSS 460 through an S6a interface 465. S6a interface 465 may be implemented, for example, using a Diameter protocol.

While FIG. 4 shows exemplary components of LTE network 400, in other implementations, LTE network 400 may include fewer components, different components, differently arranged components, or additional components than depicted in FIG. 4. Additionally or alternatively, one or more components of LTE network 400 may perform functions described as being performed by one or more other components of LTE network 400.

Figure 5:
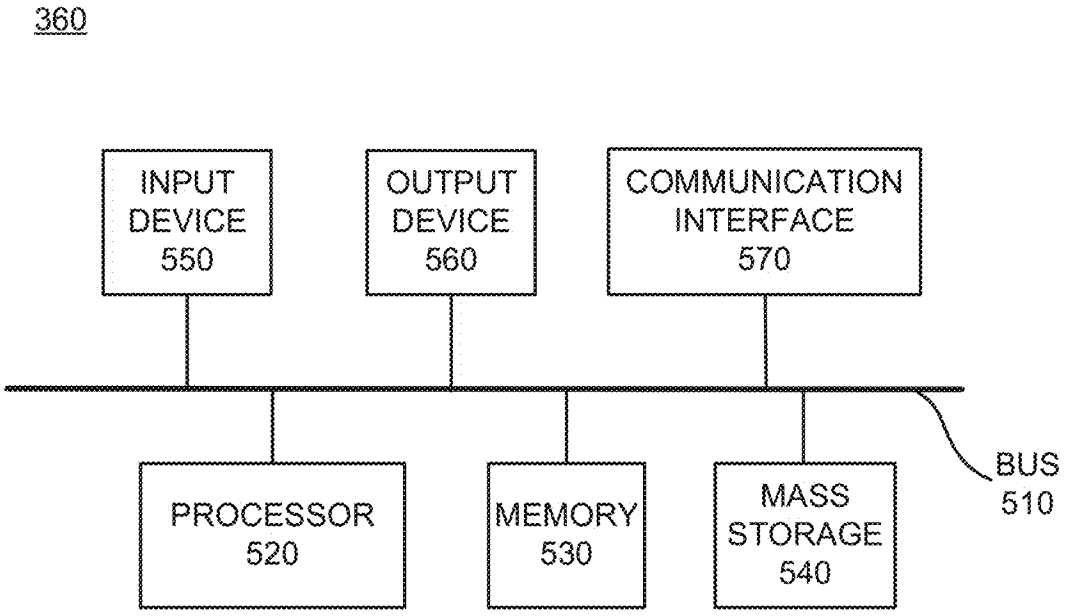
FIG. 5 is a block diagram depicting exemplary components of a storage and retrial system.

FIG. 5 is a block diagram depicting exemplary components of a storage and retrieval system 360. Storage and retrieval system 360 may include a bus 510, a processor 520, a memory 530, mass storage 540, an input device 550, an output device 560, and a communication interface 570. Other systems, illustrated in FIG. 3, such as carrier billing system 370 and sponsor system(s) 380 may be configured in a similar manner.

Bus 510 includes a path that permits communication among the components of storage and retrieval system 360. Processor 520 may include any type of single-core processor, multi-core processor, microprocessor, latch-based processor, and/or processing logic (or families of processors, microprocessors, and/or processing logics) that interprets and executes instructions. In other embodiments, processor 520 may include an application-specific integrated circuit (ASIC), a field-programmable gate array (FPGA), and/or another type of integrated circuit or processing logic. For example, processor 520 may be an x86 based CPU, and may use any operating system, which may include varieties of the Windows, UNIX, and/or Linux. Processor 520 may also use high-level analysis software packages and/or custom software written in any programming and/or scripting languages for interacting with other network entities are communicatively coupled to network environment 300.

Memory 530 may include any type of dynamic storage device that may store information and/or instructions, for execution by processor 520, and/or any type of non-volatile storage device that may store information for use by processor 520. For example, memory 530 may include a RAM or another type of dynamic storage device, a ROM device or another type of static storage device, and/or a removable form of memory, such as a flash memory. Mass storage device 540 may include any type of on-board device suitable for storing large amounts of data, and may include one or more hard drives, solid state drives, and/or various types of Redundant Array of Independent Disks (RAID) arrays. For storage and retrieval system 360, mass storage device 540 would be suitable for storing files associated with data streams transferred by mobile device 110.

Input device 550, which may be optional, can allow an operator to input information into storage and retrieval system 360, if required. Input device 550 may include, for example, a keyboard, a mouse, a pen, a microphone, a remote control, an audio capture device, an image and/or video capture device, a touch-screen display, and/or another type of input device. In some embodiments, storage and retrieval system 360 may be managed remotely and may not include input device 550. Output device 560 may output information to an operator of storage and retrieval system 360. Output device 560 may include a display (such as an LCD), a printer, a speaker, and/or another type of output device. In some embodiments, storage and retrieval system 360 may be managed remotely and may not include output device 560.

Communication interface 570 may include a transceiver that enables storage and retrieval system 360 to communicate within network environment 300 and with other devices and/or systems. Communication interface 570 may be configured for wireless communications (e.g., RF, infrared, and/or visual optics, etc.), wired communications (e.g., conductive wire, twisted pair cable, coaxial cable, transmission line, fiber optic cable, and/or waveguide, etc.), or a combination of wireless and wired communications. Communication interface 570 may include a transmitter that converts baseband signals to RF signals and/or a receiver that converts RF signals to baseband signals. Communication interface 570 may be coupled to one or more antennas for transmitting and receiving RF signals. Communication interface 570 may include a logical component that includes input and/or output ports, input and/or output systems, and/or other input and output components that facilitate the transmission/reception of data to/from other devices. For example, communication interface 570 may include a network interface card (e.g., Ethernet card) for wired communications and/or a wireless network interface (e.g., a WiFi) card for wireless communications.

As described below, storage and retrieval system 360 may perform certain operations relating to receiving and storing data streams provided by mobile device 110, and retrieving data streams for playback as requested by a user. Storage and retrieval system 360 may perform these operations in response to processor 520 executing software instructions contained in a computer-readable medium, such as memory 530 and/or mass storage 540. The software instructions may be read into memory 530 from another computer-readable medium or from another device. The software instructions contained in memory 530 may cause processor 520 to perform processes described herein. Alternatively, hardwired circuitry may be used in place of, or in combination with, software instructions to implement processes described herein. Thus, implementations described herein are not limited to any specific combination of hardware circuitry and software.

Although FIG. 5 shows exemplary components of storage and retrieval system 500, in other implementations, storage and retrieval system 500 may include fewer components, different components, additional components, or differently arranged components than depicted in FIG. 3.

Figure 6:
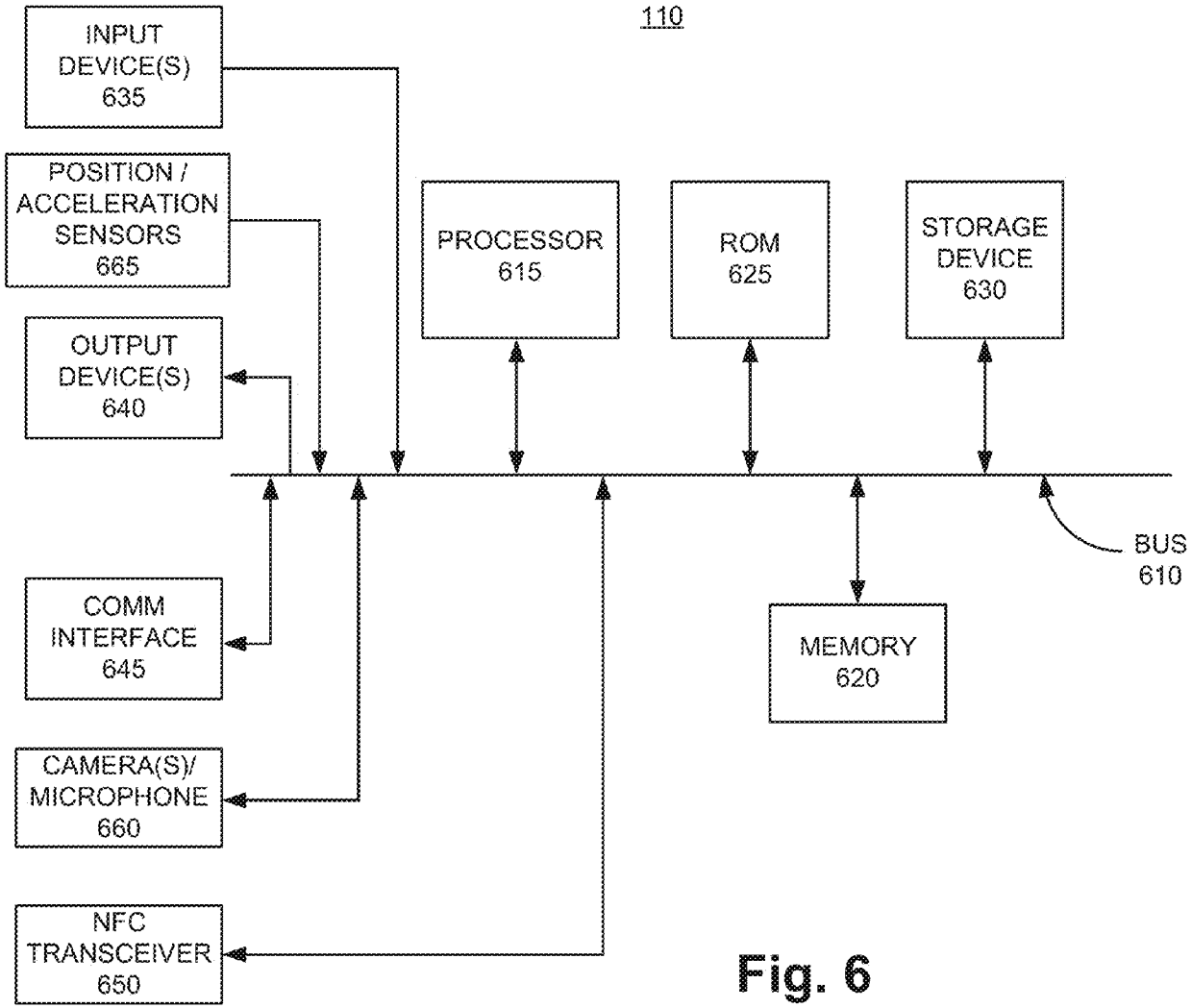
FIG. 6 is a block diagram showing exemplary components of a mobile device according to an embodiment.

FIG. 6 is a block diagram showing exemplary components of a mobile device 110 according to an embodiment. Mobile device 115 may include a bus 610, a processor 615, memory 620, a read only memory (ROM) 625, a storage device 630, one or more input device(s) 635, one or more output device(s) 640, a communication interface 645, a Near Field Communications (NFC) transceiver 650, one or more camera(s) and/or microphone 660, and position and acceleration sensors 665. Bus 610 may include a path that permits communication among the elements of mobile device 110.

Processor 615 may include a processor, microprocessor, or processing logic that may interpret and execute instructions. Memory 620 may include a random access memory (RAM) or another type of dynamic storage device that may store information and instructions for execution by processor 615. ROM 625 may include a ROM device or another type of static storage device that may store static information and instructions for use by processor 615. Storage device 630 may include a magnetic and/or optical recording medium and its corresponding drive.

Input device(s) 635 may include one or more mechanisms that permit an operator to input information to mobile device 110, such as, for example, a keypad or a keyboard, a microphone, voice recognition, components for a touchscreen, and/or biometric mechanisms, etc. Output device(s) 640 may include one or more mechanisms that output information to the operator, including a display, a speaker, etc.

Communication interface 645 may include any transceiver mechanism that enables mobile device 110 to communicate with other devices and/or systems. For example, communication interface 645 may include mechanisms for communicating with another device or system via a network.

NFC transceiver 650 may be used to receive an initiation signal provided by cradle 120. Position and/or acceleration sensors 665 may include sensors to record accelerations and stops of the vehicle, and further determine the position of the vehicle. The position determination may be performed using an internal GPS receiver.

Camera(s)/microphone sensor 660 may include one or more cameras (e.g., front facing camera 160 and/or rear facing camera 170) to record, for example, image and/or video data of the driver's view out of the front windshield, and/or the occupants in the vehicle interior. One or more microphones may be included to further record audio within the vehicle interior.

Mobile device 110 may perform certain operations or processes, as may be described in detail below. Mobile device 110 may perform these operations in response to processor 615 executing software instructions contained in a computer-readable medium, such as memory 620, ROM 625, and/or storage device 630. A computer-readable medium may be defined as a physical or logical memory device. A logical memory device may include memory space within a single physical memory device or spread across multiple physical memory devices. The software instructions may be read into memory 620 from another computer-readable medium, such as storage device 630, or from another device via communication interface 645. The software instructions contained in memory 620 may cause processor 615 to perform operations or processes that will be described in detail with respect to FIG. 7. Alternatively, hardwired circuitry may be used in place of or in combination with software instructions to implement processes consistent with the principles of the embodiments. Thus, exemplary implementations are not limited to any specific combination of hardware circuitry and software.

The configuration of components of mobile device 110 illustrated in FIG. 6 is for illustrative purposes only. It should be understood that other configurations may be implemented. Therefore, mobile device 110 may include additional, fewer and/or different components than those depicted in FIG. 6.

Figure 7:
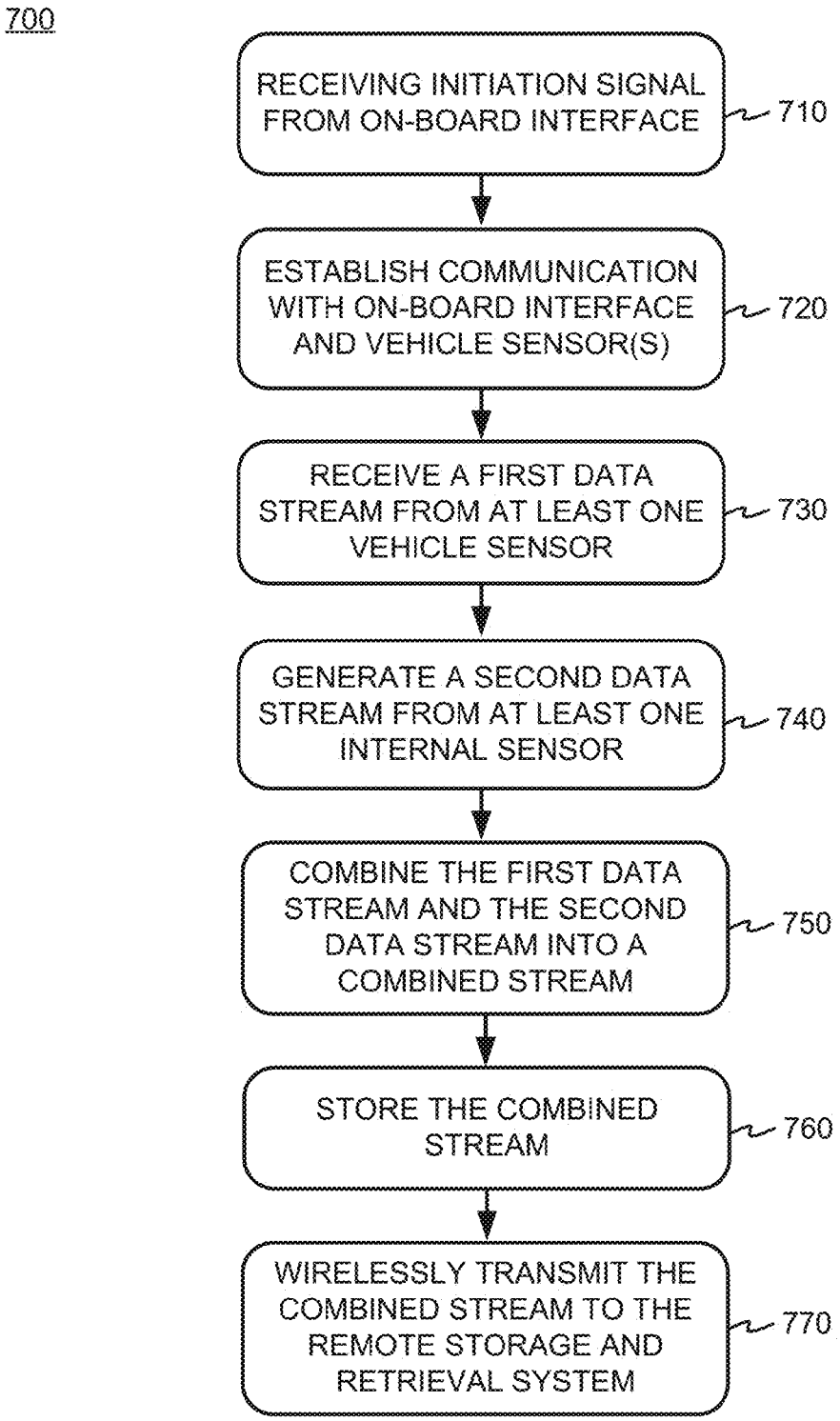
FIG. 7 is a flow chart showing an exemplary process for collecting and/or transferring data streams within a vehicle using a mobile device.

FIG. 7 is a flow chart showing an exemplary process 700 for collecting and/or transferring data streams within a vehicle using mobile device 110. Mobile device 110 may initially receive an initiation signal from an on-board interface associated with a vehicle (Block 710). In an embodiment, the on-board interface may be, for example, cradle 120, which includes a wireless transmitter. Mobile device 110 may receive a near field communications (NFC) signal from the wireless transmitter as the initiation signal. In another embodiment, mobile device 110 may receive power from the on-board interface (e.g., cradle 120) for operation within the vehicle and/or charging batteries.

Mobile device 110 may establish communications with the on-board interface and vehicle sensor(s) in response to the initiation signal (Block 720). In an embodiment, mobile device 110 may establish communications with at the vehicle sensor(s) through the on-board interface (e.g., cradle 120) and/or over a wireless interface. In an embodiment, the on-board interface may interface to a vehicle controller 210 over an On-Board Diagnostic (OBD) interface. The establishment of communications may be initiated by having mobile device 110 automatically execute an application in response to receiving the initiation signal.

The application may be downloaded by mobile device 110 and stored in memory 620, in storage device 630, or a combination thereof. The application may be downloaded, for example, when a user signs up for a particular service with a sponsor and/or a carrier network. The application may be downloaded from a third party application repository (such as, for example, an "app store") for which mobile device 110 has wireless access, or may be downloaded by mobile device 110 from a server that may be supported by a sponsor and/or a carrier network. Upon being run for the first time, the application may have mobile device 110 solicit the user for default settings, or establish them during an initialization routine (such, for example, a "guided setup" routine) which may guide the user in adapting mobile device 110 to the vehicle. Mobile device 110 may receive and store application default settings. Some of the settings may influence the behavior of how data streams for specified vehicle sensors are combined. For example, as indicated by the user, some preferences may be used to select particular data streams to combine in order to, for example, comply with the user's privacy wishes.

In an embodiment, mobile device 110 may further determine a position of the vehicle, using position and acceleration sensors 665 (which may include a GPS receiver), and set the application default settings based on the position. For example, position information may be used to conform to local ordinances or regulatory mandates of local jurisdictions regarding the legality of recording video and/or audio information.

For example, it may be illegal in a particular state to record the video and/or audio of cabin occupants without their consent, accordingly, mobile device 110 may automatically turn off the microphone if its position indicates that mobile device 110 is within such a jurisdiction. This may be accomplished by having position/acceleration sensors 665 provide the position of the vehicle to the mobile device 110 so it may look up (e.g., in memory 620 and/or storage device 630) to determine the local laws recording data collection, and comply with the local laws by activating or deactivation the appropriate internal sensors. Additionally, mobile device 110 may selectively combine the data streams generated by vehicle sensors to comply with local laws, if necessary.

Accordingly, in an embodiment, mobile device 110 may provide a notification regarding the storing and transmitting of one or more data streams. For example, the notification may be provided after mobile device 110 receives the initiation signal described above in relation to Block 710. The notification may be provided on output device 640 (e.g., a touchscreen), and inform a user associated with mobile device 110 as to the information that will be shared over network 315 when the data streams are transferred to storage and retrieval system 360. In response to the notification, the user may, through input device 635 (e.g., a touchscreen), provide permissions which may control how the data streams are combined, and thus select which data streams may be stored on mobile device 110 and/or transmitted over network 315 to storage and retrieval system 360. The permissions may be based on default values established when the application was "set up" as described above, whereby the user may simply let the notification "time-out" and enter nothing. Alternately, the user may input new permissions in response to the notification (e.g., within a specified time period prior to "timing out") to override the default settings previously set by the user. In an embodiment, if the user denies permission for one or more particular data stream(s) to be stored and/or transferred, mobile device 110 will not select the particular streams that were denied when generating the combined stream. Thus, the particular steams will not be stored and/or transferred in accordance with the permissions received from the user.

In another embodiment, mobile device 110 may receive a request from a remote device to enable (or disable) the storing and/or transferring of data stream(s) from sensors while the "in the field." The remote device may be a computer, a server, or other computing device. For example, the request may be provided by storage and retrieval system 360, carrier billing system 370, or sponsor system(s) 380. The request may trigger one or more mobile device(s) 110, which may be a subset of the total number of available mobile devices 110, to establish communications and subsequently receive data stream(s) with at least one vehicle sensor. The request may be sent in advance and be used by the mobile device(s) 110 at a later time. In an embodiment, the request may further specify which sensors may be utilized by mobile device 110 for storing and/or transferring the respective data streams.

Mobile device 110 may receive a first data stream from at least one vehicle sensor (Block 730). For example, the first data stream(s) may be received from vehicle front sensor 220, vehicle rear sensor 230, vehicle side sensors 240, 250, and/or other vehicle sensor(s) 260. The data stream(s) may correspond to at least one of video data, proximity data, radar data, ultrasonic data, occupancy sensor data, airbag deployment status data, acceleration data, velocity data, or position data.

Mobile device 110 may generate a second data stream from at least one internal sensor (Block 740). For example, the second data stream(s) may be generated by front facing camera 160 and/or rear facing camera 170. In other embodiments, internal sensors may include one or more accelerometers, a Global Positioning System (GPS) receiver, and/or a barometer.

Mobile device 110 may then combine the first data stream(s) from the vehicle sensor(s) and the second data stream(s) from the internal sensor(s) to generate a combined stream (Block 750). As noted above, the first data stream(s) and the second data stream(s) may be selectively combined based on application default settings and/or user preferences. In an embodiment, mobile device 110 may further compare data streams received from internal sensor(s) and vehicle sensor(s) to ascertain if any data is redundant. If so, the redundant data streams may eliminated to save storage space and/or reduce network traffic prior to combining. For example, mobile phone 110 may exclude data streams received from vehicle front sensor 220 from being combined if front facing camera 160 provides the same field of view at a higher quality. Such redundancies may ascertained by the application executing on mobile device 110, for example, by using preferences indicated by the user when the application is run for the first time, when a change in configuration occurs to the vehicle sensor(s), and/or by metadata associated with a particular data stream.

Mobile device may store the combined stream (Block 760). The data stream may be stored on mobile device 110 for a period of time indicated by one or more preferences set by the user through the application executing on mobile device 110. Similarly, once the data stream is transferred to storage and retrieval system 360, the user may indicate how long the transferred data streams may be stored on storage and retrieval system 360. The period of time for storage on storage and retrieval system 360 may be specified through a preference on the application executing on mobile device 110, where preferences relating to storage and retrieval system 360 stored on mobile device 110 may be transferred with combined stream over the wireless network. Alternatively, the preferences relating to storage and retrieval system 360 may be set independently through a different set of preferences stored at storage and retrieval system 360, which may be set when accessed by the user through access device 390. For example, a web browser interface, which may be used on access device 390 to log into storage and retrieval system 360, may present a web page of options indicating how long data stream may be stored. The preferences setting may be applied based on the type of sensor which generated the data stream, and/or may be applied by specifying individual data streams.

Mobile device 110 may store the combined steam (Block 760). Mobile device 110 may wirelessly transmit the combined steam to a remote storage and retrieval system 360 (Block 770). The wireless transmission may be performed, for example, over cellular network 320, wide area wireless network 330, local area wireless network 340, and/or wide area network 350.

The foregoing description of implementations provides illustration and description, but is not intended to be exhaustive or to limit the invention to the precise form disclosed. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense. For example, while series of blocks have been described with regard to FIG. 7, the order of the blocks may be modified in other embodiments. Further, non-dependent processing blocks may be performed in parallel.

Certain features described above may be implemented as "logic" or a "unit" that performs one or more functions. This logic or unit may include hardware, such as one or more processors, microprocessors, application specific integrated circuits, or field programmable gate arrays, software, or a combination of hardware and software.

To the extent the aforementioned embodiments collect, store or employ personal information provided by individuals, it should be understood that such information shall be used in accordance with all applicable laws concerning protection of personal information. Additionally, the collection, storage, and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

The terms "comprises" and/or "comprising," as used herein specify the presence of stated features, integers, steps or components but does not preclude the presence or addition of one or more other features, integers, steps, components, or groups thereof. Further, the term "exemplary" (e.g., "exemplary embodiment," "exemplary configuration," etc.) means "as an example" and does not mean "preferred," "best," or likewise.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A method, comprising:

receiving an initiation signal from an on-board interface associated with a vehicle;

establishing communications with the on-board interface and at least one vehicle sensor in response to the initiation signal, wherein establishing communications further comprises automatically executing an application in response to receiving the initiation signal, and determining application default settings associated with at least one of the at least one vehicle sensor or at least one internal sensor;

receiving a first data stream from the at least one vehicle sensor;

measuring at least one physical property through the at least one internal sensor associated with a mobile device;

generating a second data stream based on the at least one measured physical property;

combining the first data stream and the second data stream into a combined stream, wherein the first data stream and the second data stream are selectively combined based on the application default settings;

storing the combined stream in the mobile device; and wirelessly transmitting the combined stream to a remote storage and retrieval system.

2. The method of claim 1, wherein the on-board interface includes a wireless transmitter, and receiving the initiation signal further comprises:

receiving a near field communications (NFC) signal from the wireless transmitter.

3. The method of claim 1, wherein establishing communications with the at least one vehicle sensor further comprises:

communicating with the at least one vehicle sensor through at least one of the on-board interface or a wireless interface.

4. The method of claim 3, further comprising:

receiving a request from a remote device, wherein the establishing communications with the at least one vehicle sensor is based upon the remote request; and communicating with the at least one vehicle sensor through an On-Board Diagnostic (OBD) interface.

5. The method of claim 1, further comprising:

determining a position of the vehicle; and setting the application default settings based on the position.

6. The method of claim 1, further comprising:

providing a notification regarding the storing and transmitting of the first data stream and the second data stream; and receiving permissions for storing and transmitting the first data stream and second data stream in response to the notification, wherein the first data stream and the second data stream are selectively combined based on the permissions.

7. The method of claim 1, wherein receiving the first data stream from the at least one vehicle sensor further comprises receiving at least one of video data, proximity data, occupancy sensor data, airbag deployment status data, acceleration data, velocity data, or position data.

8. The method of claim 1, further comprising:

receiving power from the on-board interface for at least one of charging batteries or operation within the vehicle.

9. The method of claim 1, wherein the at least one internal sensor includes at least one of a first camera, a second camera, an accelerometer, or a Global Positioning System (GPS) receiver.

10. The method of claim 1, wherein establishing communications with the at least one vehicle sensor further comprises:

communicating with the at least one vehicle sensor through at least one of the on-board interface or a wireless interface, wherein the on-board interface includes a wireless transmitter, and receiving the initiation signal further comprises receiving a near field communications signal from the wireless transmitter.

11. A mobile device, comprising:

at least one communication interface;

at least one internal sensor;

a memory configured to store instructions; and a processor, coupled to the at least one communication interface, the at least one internal sensor, and the memory, wherein the processor is configured to execute the instructions stored in the memory to:

receive an initiation signal from an on-board interface associated with a vehicle, establish communications with the on-board interface and at least one vehicle sensor in response to the initiation signal, wherein the instructions to establish communications further cause the processor to automatically execute an application in response to receiving the initiation signal, and determine application default settings associated with at least one of the at least one vehicle sensor or the at least one internal sensor, receive a first data stream from the at least one vehicle sensor, generate a second data stream from the least one internal sensor, combine the first data stream and the second data stream into a combined stream, wherein the first data stream and the second data stream are selectively combined based on the application default settings, store the combined stream in the memory, and wirelessly transmit the combined stream to a remote storage and retrieval system.

12. The mobile device of claim 11, further comprising:

a near field communications (NFC) transceiver to receive the initiation signal from an NFC transceiver associated with the on-board interface.

13. The mobile device of claim 11, wherein the instructions to establish communications with the at least one vehicle sensor further cause the processor to:

communicate with the at least one vehicle sensor through at least one of the on-board interface or a wireless interface.

14. The mobile device of claim 13, wherein the instructions to establish communications with the at least one vehicle sensor further cause the processor to:

receive a request from a remote device, wherein establishing communications with the at least one vehicle sensor is based upon the request, and communicate with the at least one vehicle sensor through an On-Board Diagnostic (OBD) interface.

15. The mobile device of claim 11, further comprising instructions for causing the processor to:

determine a position of the vehicle; and set the application default settings based on the position.

16. The mobile device of claim 11, further comprising instructions for causing the processor to:

provide a notification regarding the storing and transmitting of the first data stream and the second data stream; and receive permissions for storing and transmitting the first data stream and the second data stream in response to the notification, wherein the first data stream and the second data stream are selectively combined based on the permissions.

17. The mobile device of claim 11, wherein the instructions to receive the first data stream from the at least one vehicle sensor further cause the processor to:

receive at least one of video data, proximity data, occupancy sensor data, airbag deployment status data, acceleration data, velocity data, or position data.

18. The mobile device of claim 11, wherein the internal sensor further comprises at least one of a first camera, a second camera, an accelerometer, or a Global Positioning System (GPS) receiver.

19. A non-transitory computer-readable medium comprising instructions, which, when executed by a processor, cause the processor to:

receive an initiation signal from an on-board interface associated with a vehicle;

establish communications with the on-board interface and at least one vehicle sensor in response to the initiation signal, wherein the instructions to establish communications further cause the processor to automatically execute an application in response to receiving the initiation signal, and determine application default settings associated with at least one of the at least one vehicle sensor or at least one internal sensor;

receive a first data stream from the at least one vehicle sensor;

measure at least one physical property through the at least one internal sensor associated with a mobile device;

generate a second data stream based on the at least one measured physical property;

combine the first data stream and the second data stream into a combined stream, wherein the first data stream and the second data stream are selectively combined based on the application default settings;

store the combined stream in the mobile device; and wirelessly transmit the combined stream to a remote storage and retrieval system.

20. The non-transitory computer-readable medium of claim 19, wherein the instructions to establish communications with the at least one vehicle sensor further cause the processor to:

communicate with the at least one vehicle sensor through at least one of the on-board interface or a wireless interface, wherein the on-board interface includes a wireless transmitter, and the instructions to receive the initiation signal further causes the process to receive a near field communications signal from the wireless transmitter.

* * * * *